US010355370B2

(12) United States Patent
McMorrow et al.

(10) Patent No.: US 10,355,370 B2
(45) Date of Patent: Jul. 16, 2019

(54) DUAL PHASED ARRAY WITH SINGLE POLARITY BEAM STEERING INTEGRATED CIRCUITS

(71) Applicant: Anokiwave,Inc., San Diego, CA (US)

(72) Inventors: Robert J. McMorrow, Concord, MA (US); Robert Ian Gresham, San Diego, CA (US)

(73) Assignee: ANOKIWAVE, INC., San Diego, CA (US)

( * ) Notice: Subject to any disclaimer, the term of this patent is extended or adjusted under 35 U.S.C. 154(b) by 0 days.

(21) Appl. No.: 15/669,575

(22) Filed: Aug. 4, 2017

(65) Prior Publication Data

US 2019/0044251 A1 Feb. 7, 2019

(51) Int. Cl.

| | |
|---|---|
| ***H01Q 21/00*** | (2006.01) |
| ***H01Q 21/22*** | (2006.01) |
| ***H01Q 3/34*** | (2006.01) |
| ***H01Q 21/06*** | (2006.01) |

(52) U.S. Cl.
CPC ..... *H01Q 21/22* (2013.01); *H01Q 3/34* (2013.01); *H01Q 21/065* (2013.01)

(58) Field of Classification Search
CPC ..... H01Q 21/22; H01Q 21/065; H01Q 3/34
USPC ..... 343/853, 700 MS, 939
See application file for complete search history.

(56) References Cited

U.S. PATENT DOCUMENTS

| | | | |
|---|---|---|---|
| 5,448,250 | A | 9/1995 | Day |
| 5,724,666 | A | 3/1998 | Dent |
| 7,087,993 | B2 | 8/2006 | Lee |
| 7,129,568 | B2 | 10/2006 | Lee et al. |
| 8,558,398 | B1 | 10/2013 | Seetharam |
| 8,866,283 | B2 | 10/2014 | Chen et al. |
| 2005/0017352 | A1 | 1/2005 | Lee |
| 2005/0082645 | A1 | 4/2005 | Lee et al. |
| 2005/0098860 | A1 | 5/2005 | Lai et al. |
| 2006/0006505 | A1 | 1/2006 | Chiang et al. |

(Continued)

FOREIGN PATENT DOCUMENTS

WO WO 2017/078851 A2 5/2017

OTHER PUBLICATIONS

Bailey, *General Layout Guidelines for RF and Mixed-Signal PCBs*, Maxim Integrated, Tutorial 5100, 10 pages, Sep. 14, 2011.

(Continued)

*Primary Examiner* — Jean B Jeanglaude
(74) *Attorney, Agent, or Firm* — Nutter McClennen & Fish LLP

(57) ABSTRACT

A phased array has a laminar substrate, a plurality of elements on the laminar substrate forming a patch phased array, and first and second sets of integrated circuits on the laminar substrate. The first set of integrated circuits, each of which are single polarity integrated circuits, connects with a first set of the plurality of elements, and are configured to operate using first signals having a first polarity. In a similar manner, each one of the second set of integrated circuits also is a single polarity integrated circuit and connects with a second set of the plurality of elements. Also, each of the second set of integrated circuits is configured to operate using second signals having a second polarity. The first polarity is substantially orthogonal to the second polarity (i.e., to not interfere with each other).

27 Claims, 6 Drawing Sheets

(56) References Cited

U.S. PATENT DOCUMENTS

| | | | | |
|---|---|---|---|---|
| 2006/0109175 | A1* | 5/2006 | Yeh | H01Q 1/38 343/700 MS |
| 2006/0135084 | A1 | 6/2006 | Lee | |
| 2008/0129634 | A1* | 6/2008 | Pera | H01Q 9/0435 343/853 |
| 2009/0253384 | A1 | 10/2009 | Gorbachov | |
| 2009/0256752 | A1 | 10/2009 | Akkermans et al. | |
| 2011/0198742 | A1 | 8/2011 | Danno et al. | |
| 2012/0313219 | A1 | 12/2012 | Chen et al. | |
| 2013/0050055 | A1 | 2/2013 | Paradiso et al. | |
| 2013/0187830 | A1 | 7/2013 | Warnick et al. | |
| 2014/0348035 | A1 | 11/2014 | Corman et al. | |
| 2016/0248157 | A1 | 8/2016 | Rao et al. | |

OTHER PUBLICATIONS

Ismail, *Introduction to RF CMOS IC Design for Wireless Applications*, Analog VLSI Lab, The Ohio State University, 117 pages, undated.

Jain, *Layout Review Techniques for Low Power RF Designs*, Application Note AN098, Texas Instruments, 15 pages, 2012.

Maxim, *5GHz, 4-Channel MIMO Transmitter, MAX2850*, Maxim Integrated Products, Inc., 33 pages, 2010.

Silicon Labs, *Layout Design Guide for the Si4455/435x RF ICs*, AN685, Silicon Laboratories, 22 pages, 2014.

International Searching Authority, International Search Report—International Application No. PCT/US2016/052215, dated May 29, 2017, together with the Written Opinion of the International Searching Authority, 17 pages.

* cited by examiner

DUAL PHASED ARRAY WITH SINGLE POLARITY BEAM STEERING INTEGRATED CIRCUITS

FIELD OF THE INVENTION

The invention generally relates to phased array systems and, more particularly, the invention relates to laminar phased arrays/patch arrays.

BACKGROUND OF THE INVENTION

Antennas that emit electronically steered beams are known in the art as "phased array antennas." Such antennas are used worldwide in a wide variety of commercial and radar applications. They typically are produced from many small radiating elements that are individually phase controlled to form a beam in the far field of the antenna.

Among other things, phased array antennas are popular due to their ability to rapidly steer beams without requiring moving parts. One problem, however, is their cost. They can cost on the order of $1000 per element. Thus, for a 1000 element array, the cost can reach or exceed $1,000,000.

SUMMARY OF VARIOUS EMBODIMENTS

In accordance with one embodiment of the invention, a phased array has a laminar substrate, a plurality of elements on the laminar substrate forming a patch phased array, and first and second sets of integrated circuits on the laminar substrate. The first set of integrated circuits, each of which are single polarity integrated circuits, connects with a first set of the plurality of elements, and are configured to operate using first signals having a first polarity. In a similar manner, each one of the second set of integrated circuits also is a single polarity integrated circuit and connects with a second set of the plurality of elements. Also, each of the second set of integrated circuits is configured to operate using second signals having a second polarity. The first polarity is substantially orthogonal to the second polarity (i.e., to not interfere with each other).

The first set of elements and the second set of elements may share at least one of the plurality of elements ("shared element"). In that case, the shared element may be configured to operate using two orthogonal signals substantially simultaneously. The first set of elements also may include at least one element that is not connected to any of the integrated circuits in the second set of integrated circuits.

The phased array also may have two sets of RF lines. Specifically, the array may have a first RF lines connecting the first set of integrated circuits to the elements in the first sets of elements, and second RF lines connecting the second set of integrated circuits to the elements in the second sets of elements. As an example, the first signals and second signals may be considered to have a given frequency, and a given first RF line may contact a given element in the first set of elements at a first point. In a corresponding manner, a given second RF line may contact the same given element at a second point that is physically spaced about 90 degrees away from the first point. The given element thus is shared between the first and second sets of integrated circuits. For example, the given element may be configured to be excited in a horizontal polarity and/or a vertical polarity at the same time.

The first set of integrated circuits and second set of integrated circuits may be substantially the same type of integrated circuit—they may have substantially identical functionality and/or circuits. Moreover, each integrated circuit may have more than one interface, and each of those interfaces may be connected with one of the plurality of elements. These interfaces need not be connected to the same element. As such, the interfaces on a given single integrated circuit may be connected to different elements.

The first set of elements may have no more than a first number of elements, while the second set of elements may have no more than a second number of elements. The first number preferably is equal to the second number, although they could be different. The total number of elements on the laminar substrate nevertheless may be greater than the sum of the first number and the second number.

In higher frequency applications, the plurality of elements may include a first element, a second element, a third element and a fourth element that collectively form a line in that order (i.e., the second element is between the first and third elements, and the third element is between the second and fourth elements). Each of the elements have respective first, second, third and fourth connection point patterns. Those patterns may alternate as progressing along the line of elements. For example, the first and third connection point patterns may be the same, while the second and fourth connection point patterns are the same. The first connection point pattern is different from the second point connection pattern, however, to form the noted alternating connection point patterns from the first to the fourth elements.

In accordance with another embodiment, a phased array has a laminar substrate, a plurality of elements on the laminar substrate forming a patch phased array, and first and second sets of single polarity integrated circuits on the laminar substrate. The first set of integrated circuits is connected with a first set of the plurality of elements. To that end, each element of the first set of elements has connection points forming a first pattern on each of the first set of elements. In a corresponding manner, the second set of integrated circuits are connected with a second set of the plurality of elements. To that end, each element of the second set of elements has connection points forming a second pattern on each of the second set of elements. The first and second patterns are configured so that the first set of elements operate at a first polarity and the second set of elements operate at a second polarity orthogonal to the first polarity.

In accordance with another embodiment, a method of forming a patch phased array forms a plurality of elements on a laminar substrate, secures a first set of single polarity integrated circuits on the laminar substrate, and connects the first set of integrated circuits with a first set of the plurality of elements so that the first set of elements is configured to operate using first signals having a first polarity. The method also secures a second set of single polarity integrated circuits on the laminar substrate, and connects the second set of integrated circuits with a second set of the plurality of elements so that the second set of elements is configured to operate using second signals having a second polarity. The first polarity is substantially orthogonal to the second polarity.

BRIEF DESCRIPTION OF THE DRAWINGS

Those skilled in the art should more fully appreciate advantages of various embodiments of the invention from the following "Description of Illustrative Embodiments," discussed with reference to the drawings summarized immediately below.

DESCRIPTION OF ILLUSTRATIVE EMBODIMENTS

In illustrative embodiments, a laminar phased array operates as a dual polarity device despite using single polarity beam steering integrated circuits. To that end, the phased array has a first set of elements/antennae that connect with a first set of integrated circuits to operate in a first polarity, and a second set of elements/antennae that connect with a corresponding second set of integrated circuits to operate in a second, preferably orthogonal polarity. Details of illustrative embodiments are discussed below.

Figure 1:
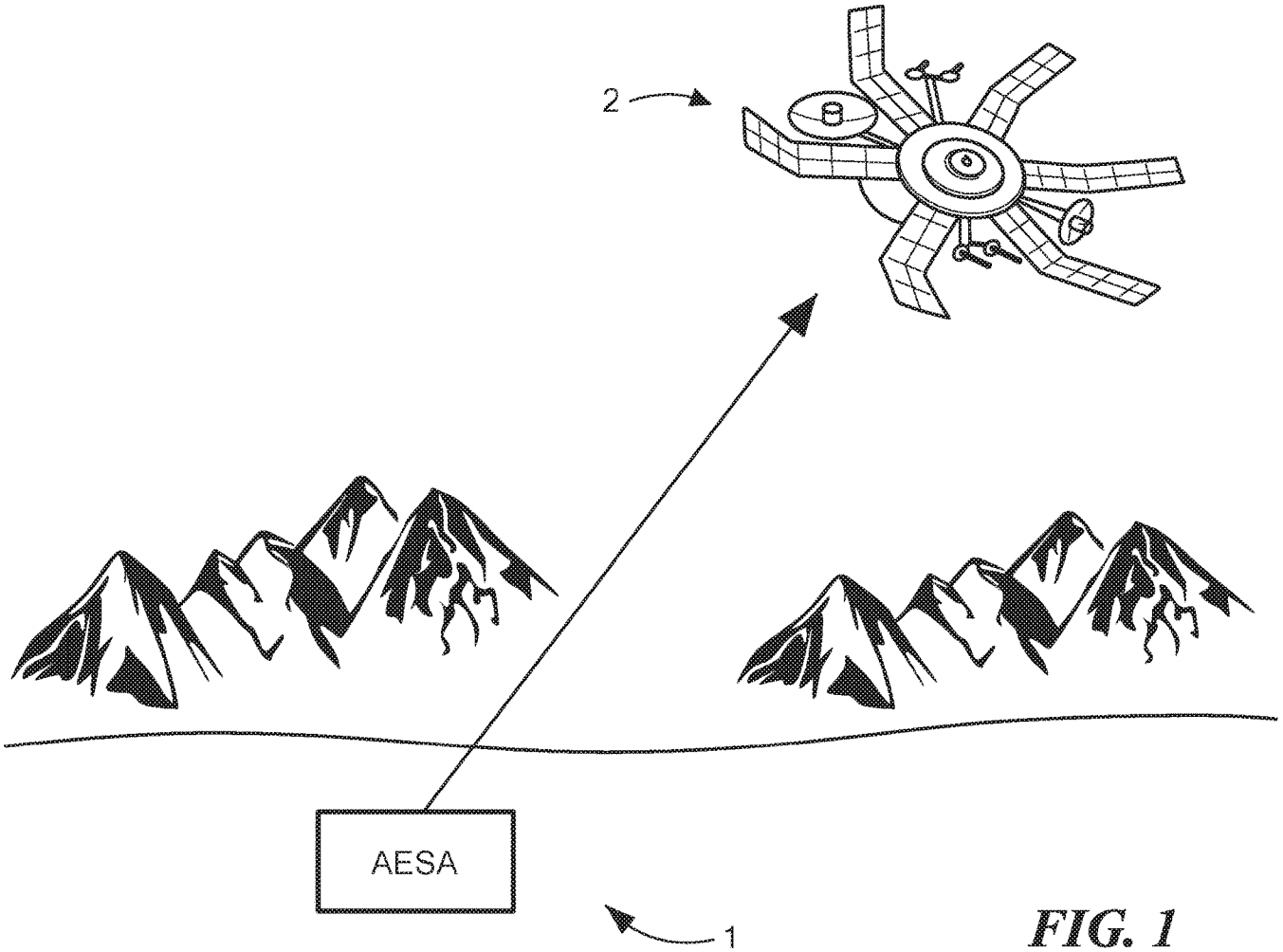
FIG. 1 schematically shows an active electronically steered antenna system ("AESA system") configured in accordance with illustrative embodiments of the invention and communicating with a satellite.

FIG. 1 schematically shows an active electronically steered antenna system ("AESA system 1") that may be configured in accordance with illustrative embodiments of the invention. In this example, the AESA system 1 communicates with an orbiting satellite 2. A phased array (discussed below and identified by reference number "10") implements the primary functionality of the AESA system 1. Specifically, as known by those skilled in the art, the phased array 10 forms one or more of a plurality of electronically steerable beams that can be used for a wide variety of applications. As a satellite communication system, for example, the AESA system 1 preferably is configured operate at one or more satellite frequencies. Among others, those frequencies may include the Ka-band, Ku-band, and/or X-band.

The satellite communication system may be part of a cellular network operating under a known cellular protocol, such as the 3G, 4G, or 5G protocols. Accordingly, in addition to communicating with satellites 2, the system 1 may communicate (e.g., transmitting signals and receiving signals) with earth-bound devices, such as smartphones or other mobile devices using any of the 3G, 4G, or 5G protocols. As another example, the satellite communication system may transmit/receive information between aircraft and air traffic control systems. Of course, those skilled in the art may use the AESA system 1 (implementing the below discussed phased array 10) in a wide variety of other applications, such as broadcasting, optics, radar, etc. Some embodiments may be configured for non-satellite communications and instead communicate with other devices, such as smartphones (e.g., using 4G or 5G protocols). Accordingly, discussion of communication with orbiting satellites 2 is not intended to limit all embodiments of the invention.

Figure 2:
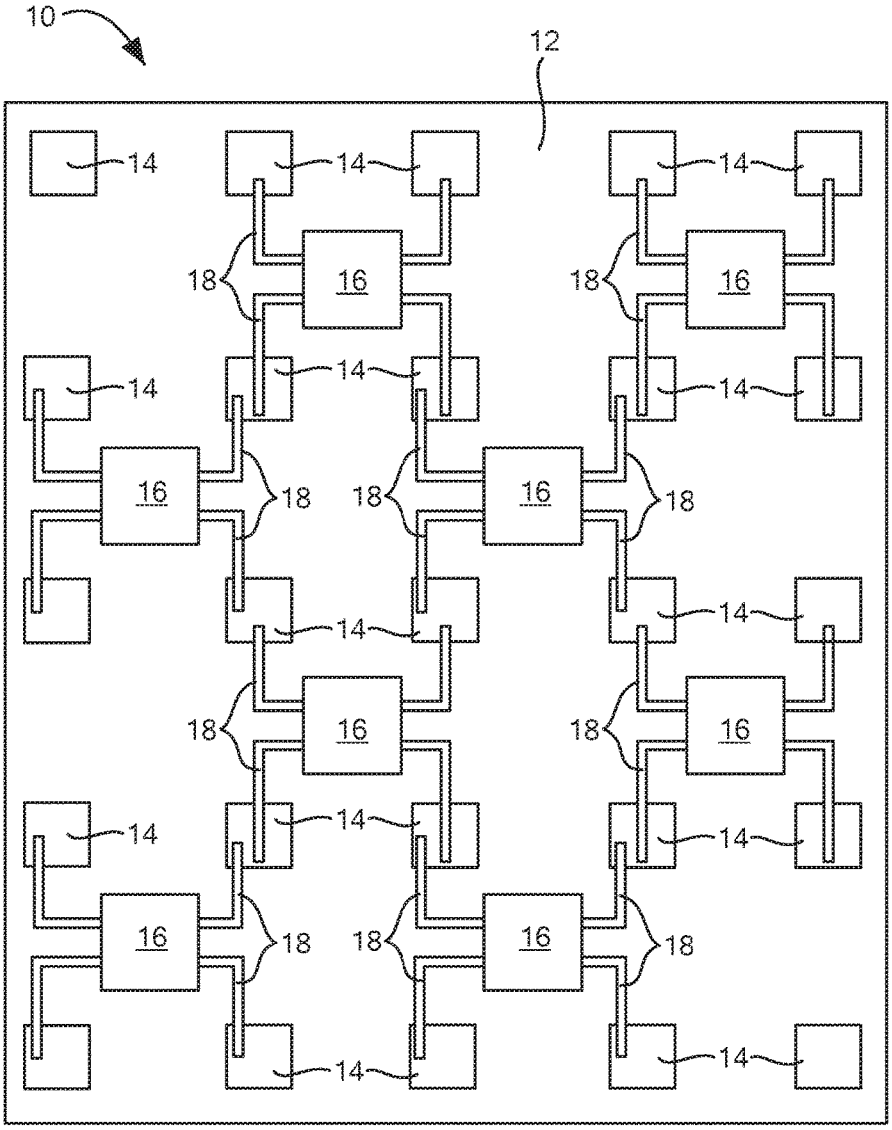
FIG. 2 schematically shows a patch array configured in accordance with illustrative embodiments of the invention.

FIG. 2 schematically shows a laminar/laminate phased array 10 configured in accordance with illustrative embodiments of the invention. In preferred embodiments, the array 10 can produce two beams that are independently steerable and encoded to convey different information. As shown, the array 10 of FIG. 2 has a printed circuit board 12 (i.e., a base or substrate) supporting a plurality of elements 14 (e.g., antennas). Specifically, the plurality of elements 14 preferably are formed as a plurality of patch antennas oriented in the configuration of a rectangular patch array 10. In this case, the elements 14 are laid out in a 5×5 array. Indeed, this is a very small phased array. Those skilled in the art can apply principles of illustrative embodiments described in terms of these small phased arrays to laminar phased arrays with dozens, hundreds, or even thousands of elements 14. For example, the array 10 of FIG. 2 can have additional rows and columns of elements 14 on each side of the array 10 as shown. In addition, the elements 14 may be laid out in another pattern, such as the pattern of a triangular patch array.

Those skilled in the art can select the appropriate numbers of elements 14 and beamforming integrated circuits 16 (discussed below) based upon the application (e.g., some lower frequency applications may require fewer elements 14). Specifically, a given application may have a specified minimum equivalent isotropically radiated power ("EIRP") for transmitting signals. In addition, that same application may have a specified minimum G/T (analogous to a signal-to-noise ratio) for receiving signals, where:

G denotes the gain or directivity of the antenna, and

T denotes the noise temperature of the receiving element 14 and is related to noise factor "F" by $T=To(F-1)$.

Accordingly, those skilled in the art may require that the array 10 have at least a minimum number of elements 14 to meet the minimum EIRP (when in a transmitting mode). Of course, the array 10 may have more elements 14 beyond that minimum number. In a similar manner, those skilled in the art may require that the array 10 have at least a minimum number of elements 14 to meet the minimum G/T. Again, like when in a transmitting mode, the array 10 also may have more elements 14 beyond that minimum number.

Other embodiments may use other requirements for selecting the appropriate number of elements 14. Accordingly, discussion of the specific means for selecting the appropriate number of elements 14 is for descriptive purposes only and not intended to limit various embodiments of the invention.

In some embodiments, the elements 14 are spaced apart from each other as a function of the wavelength of the signals expected to be transmitted and received by the AESA system 1. For example, the distances between the elements 14 may be spaced apart a distance equal to between 40-60 percent of the wavelength of the relevant signals.

As mentioned above, the array 10 has a plurality of integrated circuits 16 for controlling operation of the elements 14. Those skilled in the art often refer to these integrated circuits 16 controlling beam transmission or receipt as "beam steering integrated circuits." In illustrative embodiments, each integrated circuit 16 is configured with at least the minimum number of functions to accomplish the desired effect. As an example, depending on its role in the array 10, each integrated circuit 16 may include some or all of the following functions:

- phase shifting,
- amplitude controlling/beam weighting,
- switching between transmit mode and receive mode,
- output amplification to amplify output signals to the elements 14,
- input amplification for received RF signals (e.g., signals received from a satellite), and
- power combining and splitting between elements 14.

Indeed, some embodiments of the integrated circuits 16 may have additional or different functionality, although illustrative embodiments are expected to operate satisfactorily with the above noted functions. Those skilled in the art can configure the integrated circuits 16 in any of a wide variety of manners to perform those functions. For example, the input amplification may be performed by a low noise amplifier, the phase shifting may use conventional phase shifters, and the switching functionality may be implemented using conventional transistor-based switches.

Each integrated circuit 16 preferably operates on at least one element 14 in the array 10. For example, each integrated circuit 16 in FIG. 2 operates on four different elements 14. Other embodiments may enable the integrated circuits 16 to control more or fewer elements 14 (e.g. one, two, three, six, etc.). Those skilled in the art can adjust the number of elements 14 sharing an integrated circuit 16 based upon the application. Sharing the integrated circuits 16 between multiple elements 14 in this manner thus reduces the required total number of integrated circuits 16, correspondingly reducing the required size of the printed circuit board 12. Together, these factors should contribute to cost reductions in the array 10.

From the perspective of FIG. 2, each integrated circuit 16 has an element 14 generally to its northeast side, an element 14 generally to its northwest side, an element 14 to its southeast side, and an element 14 to its southwest side. In other words, as shown in FIG. 2, the integrated circuits 16 are positioned in an interstitial space on the top surface of the printed circuit board 12 between the elements 14. Alternatively, each integrated circuit 16 can be positioned on the opposite side of the printed circuit board 12; i.e., the side opposite to the surface with the elements 14, but in the same generally interstitial space. In that latter case, the plan profile of the integrated circuits 16 and elements 14 may overlap to some extent. For example, as discussed below, in some higher frequency applications, the plan profile of the integrated circuits 16 may overlap with the elements 14, but be on different sides of the printed circuit board 12.

RF interconnect/beam forming lines ("RF lines 18") electrically connect the integrated circuits 16 to their respective elements 14. To minimize the feed loss, illustrative embodiments mount the integrated circuits 16 as close to their respective elements 14 as possible. To that end, each integrated circuit 16 preferably is packaged either in a flipped configuration using wafer level chip scale packaging (WLCSP), or a traditional package, such as quad flat no-leads package (QFN package). This should minimize the noise figure by ensuring that each RF line 18 is correspondingly short. Preferred embodiments use low noise figure silicon processes, as benchmarked by a minimum achievable noise figure, NFmin, for optimal low noise amplifier noise figures.

As suggested above, the apparatus of FIG. 2 operates as a dual polarized array (e.g., both horizontal polarization and vertical polarization). Accordingly, the array 10 can operate by performing two different/independent or dependent functions at the same time (e.g., receiving/receiving, receiving/transmitting, or transmitting/transmitting), and transmit/receive different information.

Prior art arrays using dual polarizations, however, have a number of problems. Among other things, prior art arrays known to the inventors use dual polarization integrated circuits to drive their elements 14. Favorably, such integrated circuits reduce the total count of integrated circuits on the printed circuit board 12. Undesirably, however, dual polarization integrated circuits often are large, expensive, and complex, consequently creating thermal distribution problems. In addition, dual polarization integrated circuits often increase cross polarization interference—i.e., the horizontal polarization signals may be more prone to interfere with the vertical polarization signals.

Recognizing these problems, the inventors began experimenting with other techniques for developing an array that is more thermal efficient, less likely to have interfering signals, and be more cost effective. After some time, the inventors recognized that careful design of the array layout and connection points of the RF lines 18 with the elements 14 can solver or at least mitigate the problem. Thus, the solution enables use of lower power, smaller, and less expensive integrated circuits.

Specifically, rather than using complex dual polarity integrated circuits, the inventors used single polarity integrated circuits connected with their respective elements 14 at precise specific physical locations. In particular, he recognized that careful placement and coordination of the physical locations of the RF lines 18 with their respective elements 14 eliminates the need for dual polarity integrated circuits. Eliminating the need for those dual element integrated circuits can provide one or more benefits, such improved thermal management, lower cost, improved RF routing, and improved cross polarity isolation.

FIG. 2 therefore schematically shows one of a wide variety of potential layouts for the array 10 using single polarity integrated circuits. In this implementation, the integrated circuits 16 and elements 14 are on opposite sides of the printed circuit board 12. For discussion purposes, the side having the integrated circuits 16 may be considered the "back-side," while the side having the elements 14 may be considered the "front-side." As shown, each one of the integrated circuits 16 has four interfaces. Using one RF line 18 (or more, if needed), each of those integrated circuit interfaces connects with one element 14 using a via (not shown) extending through the printed circuit board 12 to the desired element 14. Thus, the RF lines 18 extend along the back-side of the printed circuit board 12 and electrically connect with the elements 14 at precise locations. Each of these connection points may be considered to form a "connection pattern" or "connection point pattern" on the respective elements 14.

Those skilled in the art calculate the appropriate connection locations on the elements 14 for both the vertical polarity signals and the horizontal polarity signals. Those locations may be selected based upon the design of the element 14 for which the array 10 is to be used. Accordingly, those skilled in the art preferably select the appropriate element connection locations for the vertical polarity signals to be physically located about 90 degrees from the element connection locations for the horizontal polarity signals. Thus, the vertical polarity signals excite the elements 14 with the electric field in the vertical direction, while the horizontal polarity signals excite the elements 14 with their electric fields in the horizontal direction. The electric fields are thus orthogonal. Corresponding vertical and horizontal signals may be used for receiving signals. Using the phased array 10 of FIG. 2 as an example, the RF lines 18 for vertical polarity signals may be configured to connect with their elements 14 at or near the center of the lower edge of the element 14 (from the perspective of the drawing). In contrast, the RF lines 18 operating with horizontal polarities may be configured to connect with their elements 14 at or near the center of the left edge of the element 14. In illustrative embodiments, each of these integrated circuits 16 are substantially identical—they each have the same functionality and circuitry and preferably are configured to operate using the same polarity. In alternative embodiments, each of the integrated circuits 16 may have different functionality and/or circuitry.

As shown, some of the elements 14 are connected with two separate integrated circuits 16 at the two noted locations. In that case, two different integrated circuits are considered to share a single element 14, operating using two polarities. For example, the nine interior elements 14 (i.e., elements 14 each having at least one element 14 between it and the edge of the printed circuit board 12) each are connected with two integrated circuits 16. For each of those elements 14, one of the connection points is located at the general center of its lower edge (vertical polarity), while the other is located at the general center of its left edge (horizontal polarity).

Other elements 14 in the array 10 are connected with only one integrated circuit 16 and thus, operate using only one polarity. For example, fourteen of the exterior elements 14 each are connected with only one integrated circuit 16. To that end, seven of the nine elements 14 along the top and right side of the array 10 are connected with one integrated circuit 16 in a manner to operate using a vertical polarity. In a complementary fashion, seven of the nine elements 14 along the bottom and left side of the array 10 are connected with one integrated circuit in a manner to operate using a horizontal polarity. It should be noted that the array 10 of FIG. 2 has dummy elements 14 at its top left and lower right—connected to no integrated circuits 16. Both of those dummy elements 14 may be omitted and are simply included to simplify fabrication of the array 10.

Figure 3A:
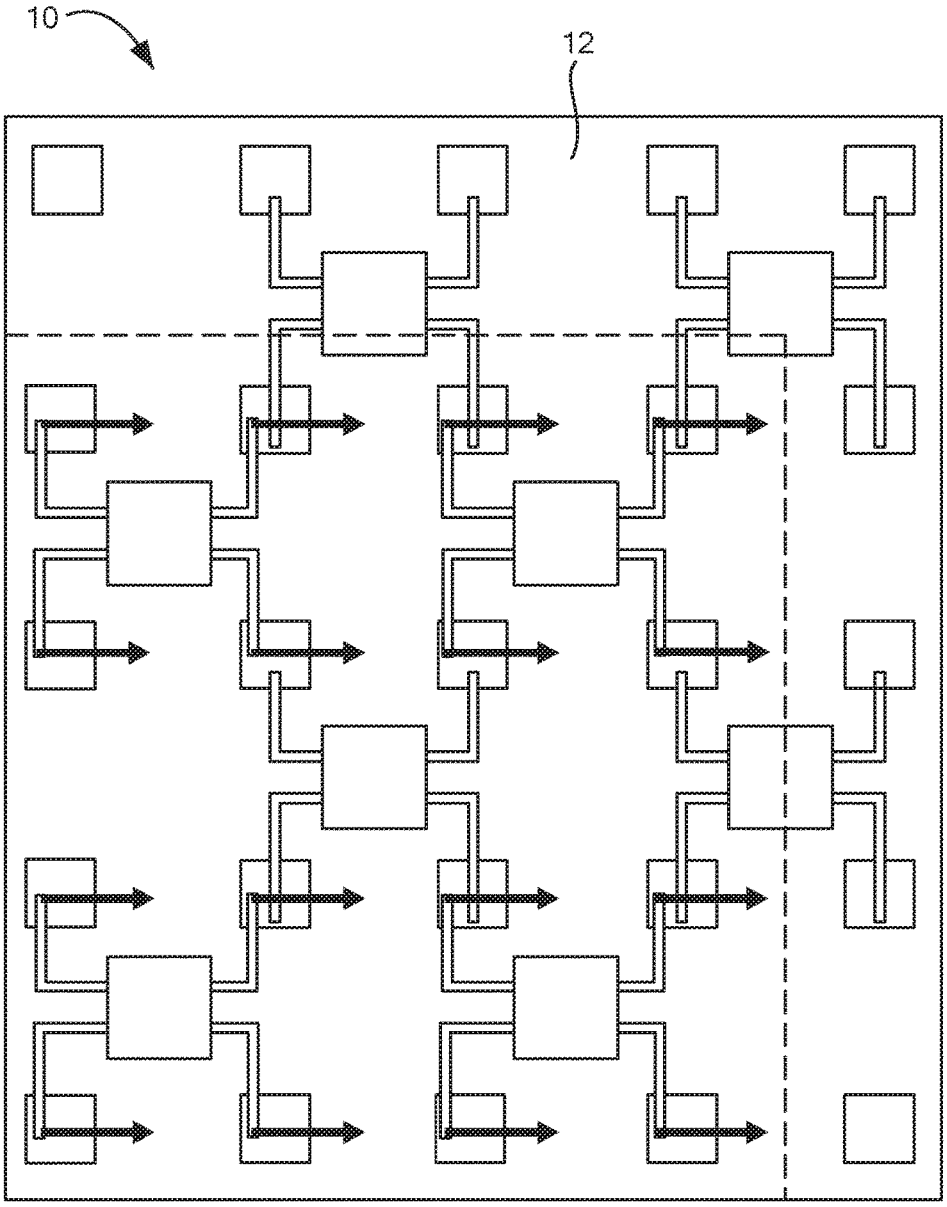
FIG. 3A schematically shows a first portion of the patch array of FIG. 2.
Figure 3B:
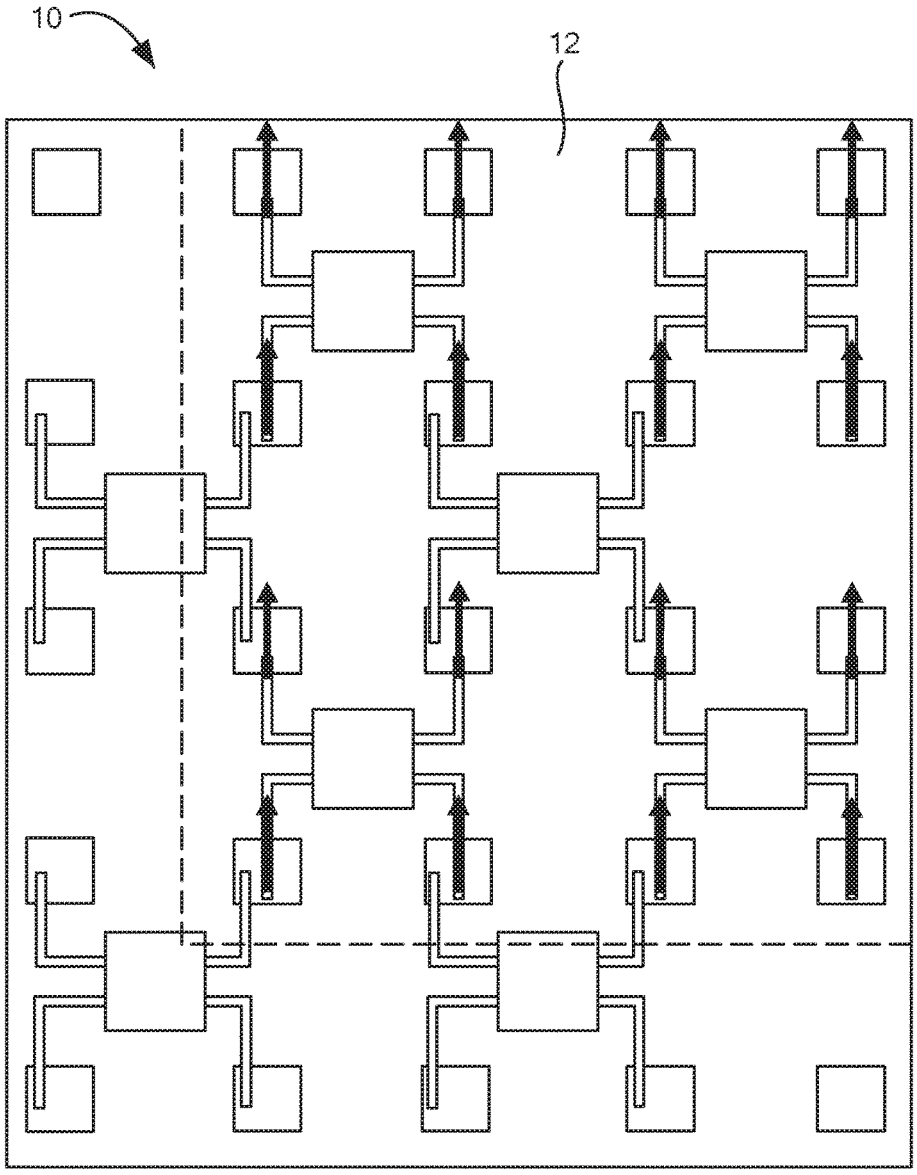
FIG. 3B schematically shows a second portion of the patch array of FIG. 2.

Using this technique, the array 10 effectively forms two same-sized, sixteen element arrays—a horizontal polarity array and a vertical polarity array—that can operate independently. Indeed, both arrays share elements 14. FIG. 3A schematically shows the elements 14 forming the horizontal polarity array as those elements 14 within the dashed box. The arrows pointing to the right from the elements 14 show this polarization. In a corresponding manner, FIG. 3B schematically shows the elements 14 forming the vertical polarity array as those elements 14 within its dashed box. The arrows pointing upwardly from the elements 14 show this polarization.

Accordingly, to produce two same-sized, sixteen element arrays, illustrative embodiments must include an additional row and additional column of elements 14. Some skilled in the art may consider this a negative attribute because it increases the size/footprint of the array 10.

Despite that potentially perceived negative to this solution, the inventors recognized that these additional elements 14 add minimal cost/complexity due to the relatively low cost of adding elements 14 to the printed circuit board 12. In fact, the inventors recognized that this increased printed circuit board size enables more room for RF line routing, as well as improved thermal management. Specifically, the larger area enables more flexibility and surface area for heat dissipation.

In addition, the benefit of being able to use single polarity integrated circuits 16 further enhances the thermal benefits because they generally dissipate much less thermal energy than that dissipated by dual polarity integrated circuits. The smaller footprint of single polarity integrated circuits 16 further aids this end. These combined benefits are expected to significantly reduce the often complex task of managing the thermal profile of the array 10.

The inventors determined that illustrative embodiments, such as those like the array 10 in FIG. 2, satisfactorily space the elements 14 and integrated circuits at lower frequencies. Specifically, twice as many integrated circuits fit in the lattice when compared to prior art arrays using dual polarity integrated circuits. This is so because the lattice spacing is proportional to the frequency—typically about half of the wavelength. For example, arrays 10 operating at 28 GHz or less enable reasonable spacing across the printed circuit board 12. Arrays 10 that operate at higher speeds, such as 39 GHz, may present problems to this design. Specifically, with the smaller lattice spacing, the integrated circuits 16 and RF lines 18 may fit but can be extremely crowded. Two layers may be required to enable routing of the RF lines 18 to avoid interference.

Figure 4:
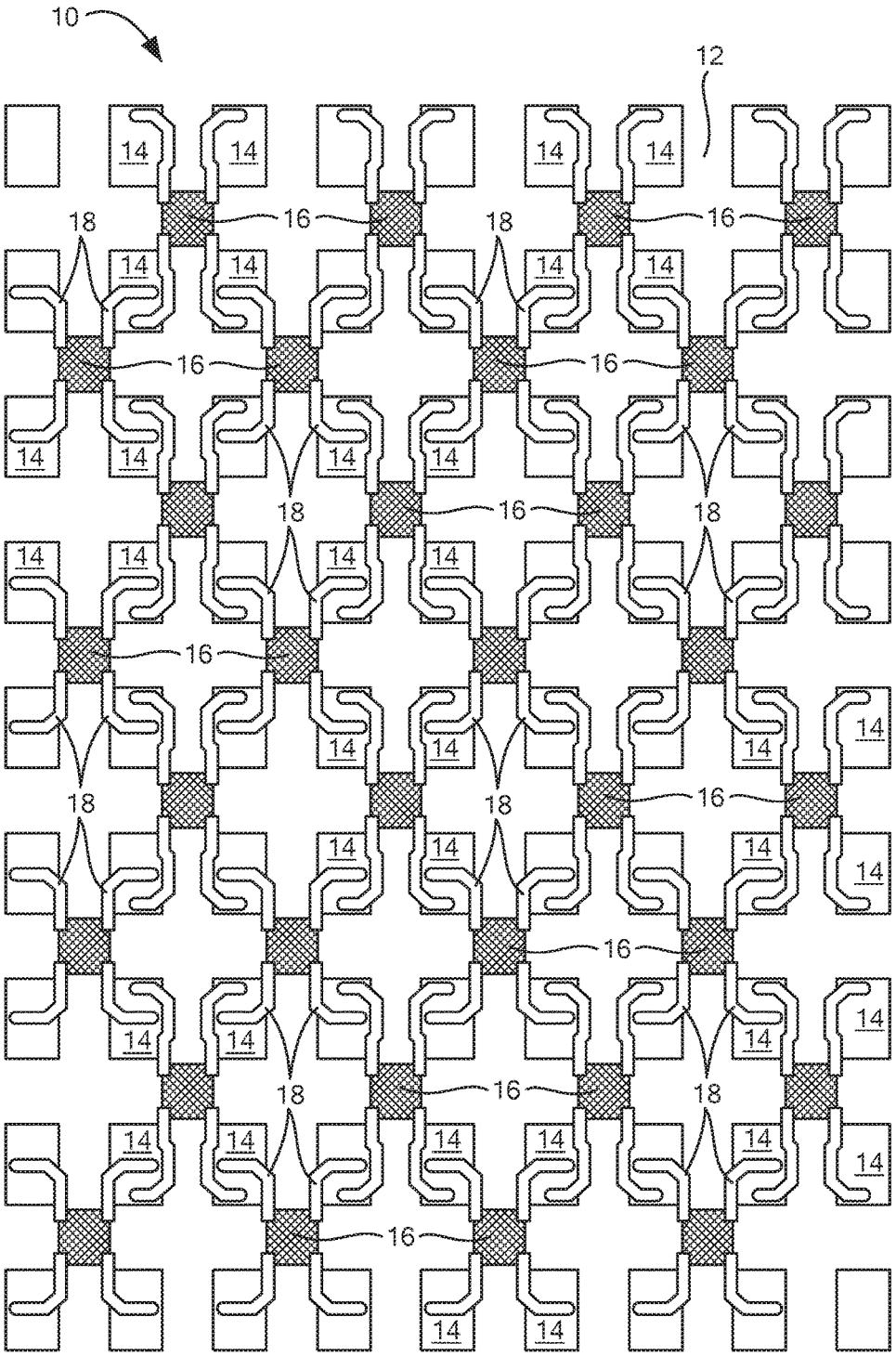
FIG. 4 schematically shows a higher frequency patch array configured in accordance with illustrative embodiments of the invention.

The design of FIG. 4 addresses these issues. Specifically, FIG. 4 shows an array 10 designed for high frequencies, such as 39 GHz or higher. As shown, this technique uses alternating feed points on the elements 14 to improve the spacing between the integrated circuits. The phase from the integrated circuits 16 can be adjusted by 180 degrees to keep the phases and sync with other elements 14.

The elements 14 thus have alternating connection patterns. For example, from left to right, the connection pattern of elements 14 with two connections points may have one alternating connection point and one non-alternating connection point. To that end, in FIG. 4, the alternating connection point alternates between the right side and the left side (along the horizontal line of elements 14). The other connection point remains the same. This configuration thus is considered to be an alternating connection pattern.

At the same time, from top to bottom, the connection pattern of elements 14 with two connections points also may have one alternating connection point and one non-alternating connection point. To that end, in FIG. 4, the alternating connection point alternates between the top and bottom sides (along the vertical line of elements 14). The other connection point remains the same from top to bottom. This configuration thus also is considered to be an alternating connection pattern.

Some of the non-interior elements 14 (i.e., the "edge elements 14") may participate in this alternating pattern, while others may not participate in this alternating pattern. In some embodiments, both of the connection points alternate. Other embodiments may not alternate every other element 14 and instead, alternate every two or three elements 14. Other alternating patterns may be used. Moreover, the connection patterns may differ from the examples above.

Among other benefits, various alternating arrangements embodiments, such as those discussed above, facilitates spacing and permits RF line routing on a single layer.

As an array 10 of patch antennas, the elements 14 have a low profile. Specifically, as known by those skilled in the art, a patch antenna/element can be mounted on a flat surface and includes a flat rectangular sheet of metal (known as the "patch") mounted over a larger sheet of metal known as a "ground plane." A dielectric layer between the two metal plates electrically isolates the two plates to eliminate direct conduction. When energized, the patch and ground plane together produce a radiating electric field. Illustrative embodiments may form the patch antennas/elements 14 using conventional semiconductor fabrication processes, such as by depositing successive metal layers that form the noted metal plates/elements 14. Accordingly, using these fabrication processes, each element 14 in the array 10 should have a very low profile.

Figure 5:
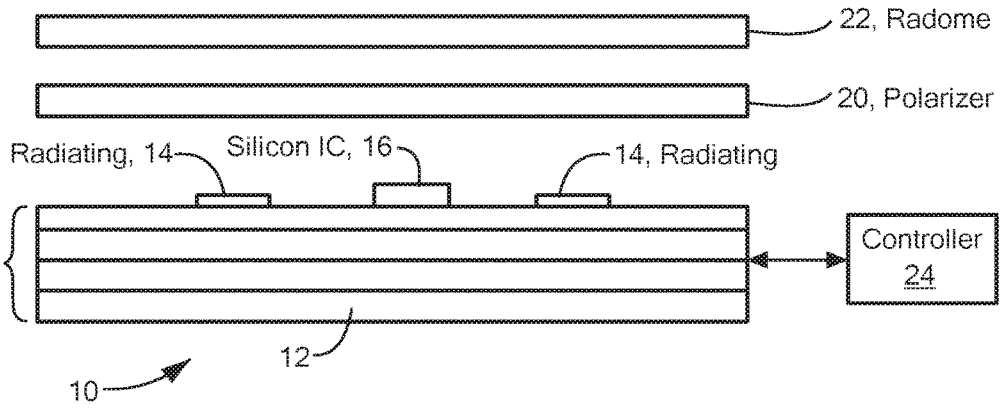
FIG. 5 schematically shows a cross-sectional view of a portion of the patch array of FIG. 2 after it is packaged.

To that end, FIG. 5 schematically shows a cross-sectional view of a small portion of the array 10 of FIG. 2. This view shows one single silicon integrated circuit 16 mounted onto the printed circuit board 12 between two elements 14; i.e., on the same side of the printed circuit board 12 juxtaposed with the two elements 14. Alternatively, as noted above, the integrated circuit 16 could be on the back-side of the printed circuit board 12. In addition, the array 10 also has a polarizer 20 to selectively filter signals to and from the array 10, and a radome 22 to environmentally protect the array 10. A separate antenna controller 24 may electrically connect with the array 10 to calculate beam steering vectors and switch between the receive mode and the transmit mode.

Figure 6:
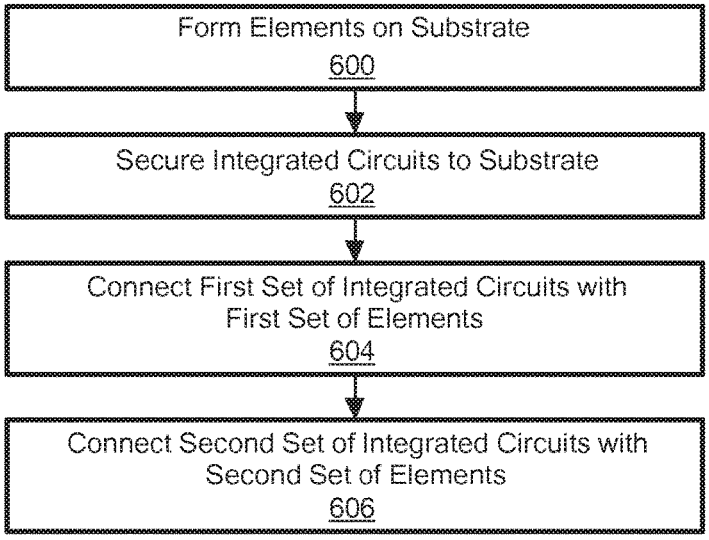
FIG. 6 shows a process of forming the patch array of FIG. 2.

FIG. 6 shows a process of forming the phased array 10 and AESA system 1 in accordance with illustrative embodiments of the invention. It should be noted that this process is substantially simplified from a longer process that normally would be used to form the AESA system 1. Accordingly, the process of forming the AESA system 1 is expected to have many steps, such as testing steps, soldering steps, or passivation steps, which those skilled in the art may use.

In addition, some of the steps may be performed in a different order than that shown, or at the same time. Those skilled in the art therefore can modify the process as appropriate. Moreover, as noted above and below, the discussed materials and structures are merely examples. Those skilled in the art can select the appropriate materials and structures depending upon the application and other constraints. Accordingly, discussion of specific materials and structures is not intended to limit all embodiments.

The process of FIG. 6 begins at step 600, which forms the array 10 of elements 14 on the substrate/printed circuit board 12. The elements 14 preferably are formed from metal deposited onto the substrate 12 in a specific lattice configuration, such as a triangular or rectangular lattice (discussed above). This step also may form pads (not shown). In preferred embodiments and as discussed above, the elements 14 are spaced apart from each other as a function of the wavelength of the signals expected to be transmitted and received by the AESA system 1. For example, the distances between the elements 14 may be spaced apart a distance equal to between 40-60 percent of the wavelength of the relevant signals.

At step 602, the process secures the integrated circuits 16 to the printed circuit board 12/substrate 12. To those ends, as noted above, when using WLCSP integrated circuits 16, illustrative embodiments may use conventional flip-chip mounting processes.

Next, the process connects a first set of the integrated circuits with a first set of elements 14 (step 604) and connects a second set of the integrated circuits with a second set of elements 14 (step 606). To that end, the process forms two sets of RF lines 18 that electrically connect the integrated circuits 16 with the elements 14, such as in the manner as shown in FIG. 2. As noted above, the first and second sets of integrated circuits may share some elements 14. In other embodiments, however, the first and second sets of integrated circuits may have separate elements 14 not in the other integrated circuit set. The total number of elements 14 in each of the first and second sets of elements 14 may be the same. Together, the two sets of elements 14 may not include all of the elements 14 of the array 10, as shown in FIG. 2. Other embodiments, however, may include all elements 14 in at least one of the sets of elements 14.

The flip chip connection of step 602 thus directly electrically connects the integrated circuits 16 to the elements 14. To that end, such embodiments may deposit solder paste (e.g., powdered solder and flux) on pads of the printed circuit board 12, and position the integrated circuits 16 on their respective board pads. Then, the printed circuit board 12 may be heated (e.g., using a reflow oven or process) to physically and electrically couple the pads with the solder.

Some embodiments that do not use flip-chip mounted WLCSP integrated circuits 16, however, may require an additional step to electrically connect the integrated circuits 16 the elements 14. For example, a wirebond operation may be required to solder wirebonds between the integrated circuits 16 and the elements 14.

After completing this process, various embodiments may secure the polarizer 20 and radome 22.

In some embodiments, a polarizer 20 can be used before the radome 22 to create circularly polarized waves from the combination of vertical and horizontal electromagnetic waves. The phase difference between the vertical and horizontal polarity can be adjusted to make this Right-Hand-Circular (RHC), or Left-Hand-Circular (LHC).

Accordingly, illustrative embodiments enable the functionality of a dual-polarized array using smaller, single polarized integrated circuits. Among other benefits, in various embodiments, this improves cross-talk interference, thermal issues, and element/integrated circuit routing problems.

Although the above discussion discloses various exemplary embodiments of the invention, it should be apparent that those skilled in the art can make various modifications that will achieve some of the advantages of the invention without departing from the true scope of the invention.

What is claimed is:

1. A phased array comprising:

a laminar substrate;

a plurality of elements on the laminar substrate forming a patch phased array;

a first set of integrated circuits on the laminar substrate, the first set of integrated circuits being single polarity integrated circuits, the first set of integrated circuits connected with a first set of the plurality of elements, the first set of integrate circuits configured to operate using first signals having a first polarity; and a second set of integrated circuits on the laminar substrate, the second set of integrated circuits being single polarity integrated circuits, the second set of integrated circuits connected with a second set of the plurality of elements, the second set of integrated circuits configured to operate using second signals having a second polarity, the first polarity being substantially orthogonal to the second polarity.

2. The phased array as defined by claim 1 wherein the first set of elements and the second set of elements share at least one of the plurality of elements ("shared element").

3. The phased array as defined by claim 2 wherein the first set of elements includes at least one element that is not connected to any of the integrated circuits in the second set of integrated circuits.

4. The phased array as defined by claim 2 wherein the shared element is configured to operate using two orthogonal signals substantially simultaneously.

5. The phased array as defined by claim 1 further comprising:

first RF lines connecting the first set of integrated circuits to the elements in the first sets of elements; and second RF lines connecting the second set of integrated circuits to the elements in the second sets of elements.

6. The phased array as defined by claim 5 wherein a given first RF line contacts a given element in the first set of elements at a first point, a given second RF line contacts the given element in the first set of elements at a second point, the first and second points being spaced physically about 90 degrees apart, the given element being shared between the first and second sets of integrated circuits.

7. The phased array as defined by claim 6 wherein a given element in the first set of elements is spaced apart between about 0.4 and 0.6 times the given frequency from an adjacent element in the first set of elements.

8. The phased array as defined by claim 6 wherein the given element is configured to be excited in a horizontal polarity and/or a vertical polarity at the same time.

9. The phased array as defined by claim 1 wherein the first set of integrated circuits and second set of integrated circuits are substantially the same type of integrated circuit.

10. The phased array as defined by claim 1 wherein each integrated circuit has more than one interface, each of the more than one interface being connected with one of the plurality of elements, the interfaces on a single integrated circuit being connected to different elements.

11. The phased array as defined by claim 1 wherein the first set of elements has no more than a first number of elements, further wherein the second set of elements has no more than a second number of elements, the first number being equal to the second number.

12. The phased array as defined by claim 1 wherein the plurality of elements includes a given element that is not part of the first set of elements and not part of the second set of elements.

13. The phased array as defined by claim 1 wherein the plurality of elements includes a first element, a second element, a third element and a fourth element, the first, second, third and fourth elements forming a line, the second element being between the first and third elements, the third element being between the second and fourth elements, the first element having a first connection point pattern, the second element having a second connection point pattern, the third element having a third connection point pattern, the fourth element having a fourth connection point pattern, the first and third connection point patterns being the same, the second and fourth connection point patterns being the same, the first connection point pattern being different from the second point connection pattern to form alternating connection point patterns from the first to the fourth elements.

14. A phased array comprising:

a laminar substrate;

a plurality of elements on the laminar substrate forming a patch phased array;

a first set of integrated circuits on the laminar substrate, the first set of integrated circuits connected with a first set of the plurality of elements, each element of the first set of elements having connection points forming a first pattern on each of the first set of elements; and a second set of integrated circuits on the laminar substrate, the second set of integrated circuits connected with a second set of the plurality of elements, each element of the second set of elements having connection points forming a second pattern on each of the second set of elements, the first and second sets of integrated circuits being single polarity integrated circuits, the first and second patterns configured so that the first set of elements operate at a first polarity and the second set of elements operate at a second polarity orthogonal to the first polarity.

15. The phased array as defined by claim 14 wherein the first set of elements and the second set of elements share at least one of the plurality of elements ("shared element").

16. The phased array as defined by claim 14 wherein the first set of elements includes at least one element that is not connected to any of the integrated circuits in the second set of integrated circuits.

17. The phased array as defined by claim 14 wherein the shared element is configured to operate using two orthogonal signals substantially simultaneously.

18. The phased array as defined by claim 14 further comprising:

first RF lines connecting the first set of integrated circuits to the elements in the first sets of elements according to the first pattern; and second RF lines connecting the second set of integrated circuits to the elements in the second sets of elements according to the second pattern.

19. The phased array as defined by claim 14 wherein the first set of integrated circuits and second set of integrated circuits are substantially the same type of integrated circuit.

20. The phased array as defined by claim 14 wherein the plurality of elements includes a first element, a second element, a third element and a fourth element, the first, second, third and fourth elements forming a line, the second element being between the first and third elements, the third element being between the second and fourth elements, the first element having the first pattern, the second element having the second pattern, the third element having the first pattern, the fourth element having the second pattern.

21. A method of forming a patch phased array, the method comprising:

forming a plurality of elements on a laminar substrate;

securing a first set of single polarity integrated circuits on the laminar substrate;

connecting the first set of integrated circuits with a first set of the plurality of elements so that the first set of elements is configured to operate using first signals having a first polarity;

securing a second set of single polarity integrated circuits on the laminar substrate;

connecting the second set of integrated circuits with a second set of the plurality of elements so that the second set of elements is configured to operate using second signals having a second polarity, the first polarity being substantially orthogonal to the second polarity.

22. The method as defined by claim 21 further comprising:

forming an alternating connection pattern on each of the elements.

23. The method as defined by claim 21 wherein the first set of elements and the second set of elements are connected to share at least one of the plurality of elements ("shared element").

24. The method as defined by claim 23 wherein the first set of elements includes at least one element that is not connected to any of the integrated circuits in the second set of integrated circuits.

25. The method as defined by claim 22 further comprising configuring the shared element to operate using two orthogonal signals substantially simultaneously.

26. The method as defined by claim 21 further comprising:

forming first RF lines connecting the first set of integrated circuits to the elements in the first sets of elements; and forming second RF lines connecting the second set of integrated circuits to the elements in the second sets of elements.

27. The method as defined by claim 21 wherein the first set of integrated circuits and second set of integrated circuits are substantially the same type of integrated circuit.

* * * * *